US006748887B2

(12) United States Patent
Cerliani

(10) Patent No.: US 6,748,887 B2
(45) Date of Patent: Jun. 15, 2004

(54) VERTICAL AXIS HOOK FOR LOCKSTITCH SEWING MACHINE, WITH SCREW-ADJUSTABLE NEEDLE GUARD PLATE

(76) Inventor: Daniele Cerliani, Piazza Dante, 7-27100, Pavia (IT)

( * ) Notice: Subject to any disclaimer, the term of this patent is extended or adjusted under 35 U.S.C. 154(b) by 0 days.

(21) Appl. No.: 10/316,207

(22) Filed: Dec. 10, 2002

(65) Prior Publication Data

US 2003/0167988 A1 Sep. 11, 2003

(30) Foreign Application Priority Data

Mar. 6, 2002 (IT) ..... MI2002A0456

(51) Int. Cl.[7] ..... D05B 57/26
(52) U.S. Cl. ..... 112/184
(58) Field of Search ..... 112/181, 184, 112/189, 196, 228, 229, 230, 231

(56) References Cited

U.S. PATENT DOCUMENTS 2,435,358 A * 2/1948 Kessler ..... 112/228
2,716,956 A * 9/1955 Parry ..... 112/230
3,120,204 A * 2/1964 Ketterer ..... 112/228
3,381,642 A * 5/1968 Bono ..... 112/229
3,545,390 A * 12/1970 Kucera ..... 112/164
4,478,162 A 10/1984 Bierweller
5,474,004 A * 12/1995 Badillo ..... 112/230

* cited by examiner

*Primary Examiner*—Ismael Izaguirre
(74) *Attorney, Agent, or Firm*—Christensen O'Connor Johnson Kindness PLLC

(57) ABSTRACT

A vertical axis hook (10) for a lockstitch sewing machine comprises a hook body (11) with a hook point and a peripheral needle guard plate (12) mounted on the hook body, the plate comprising a fastening and positioning portion and an adjustable portion integral with each other. It further comprises a plate adjustment means to adjust the radial position of the adjustable portion with respect to the hook point. The plate adjustment and positioning means (16) acts in a position of the adjustable portion of the plate which is near the fastening portion thereof.

17 Claims, 8 Drawing Sheets

FIG. 10
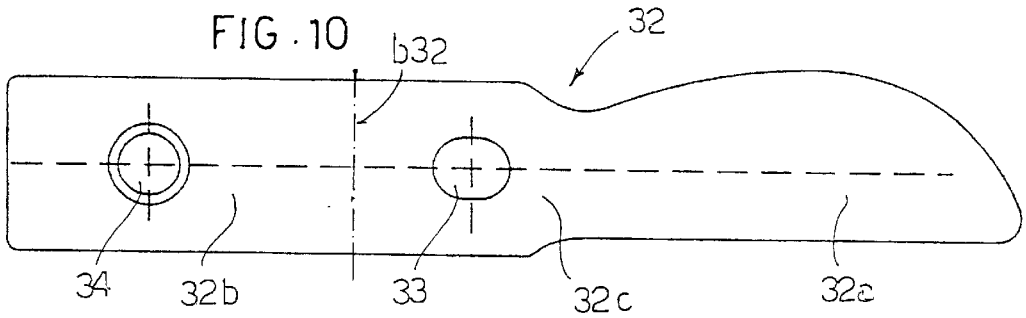
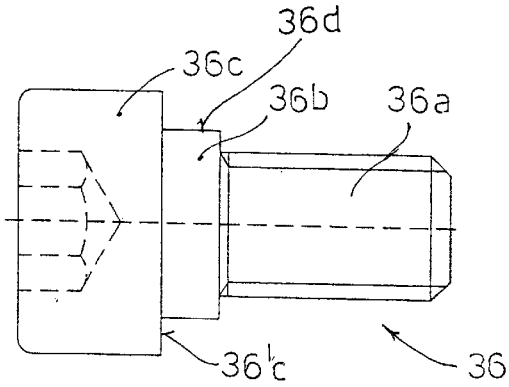
FIG. 11
FIG. 12
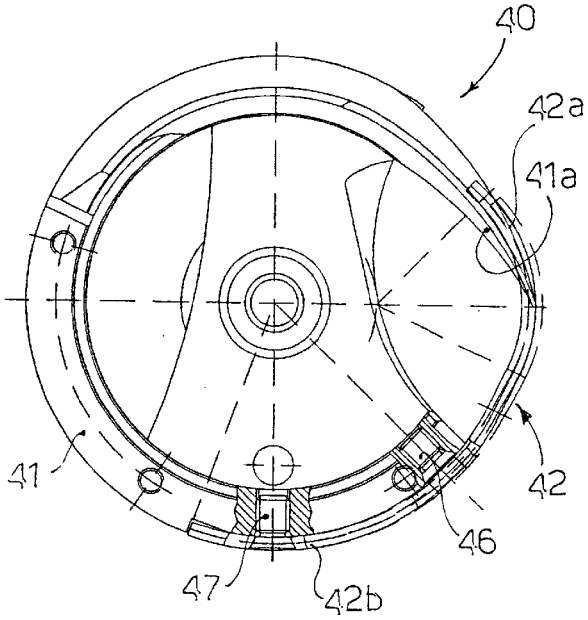
FIG. 13
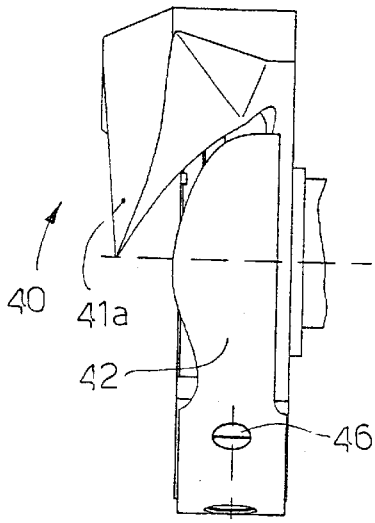

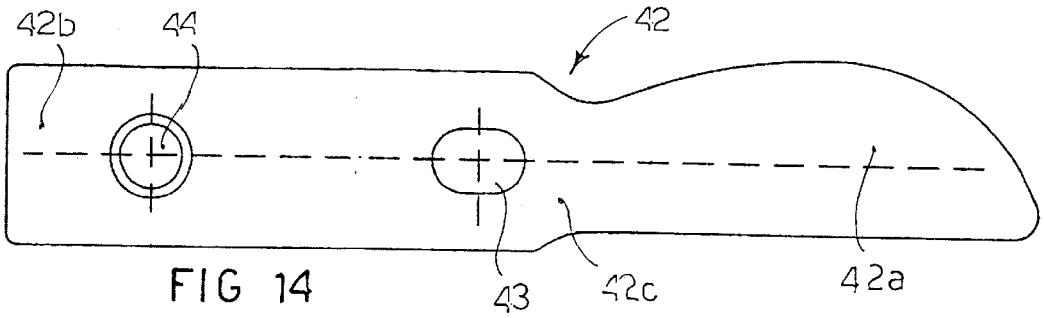
FIG 14
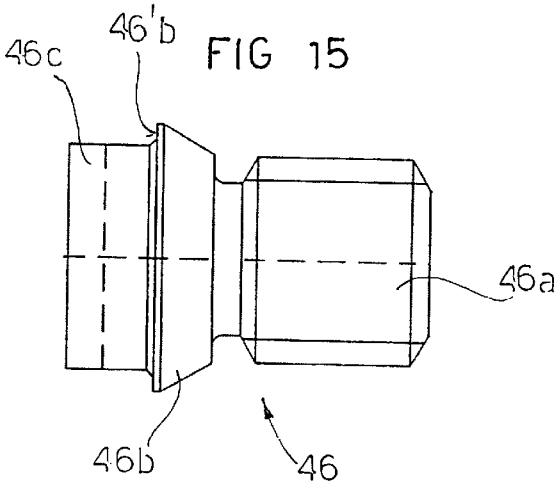
FIG 15
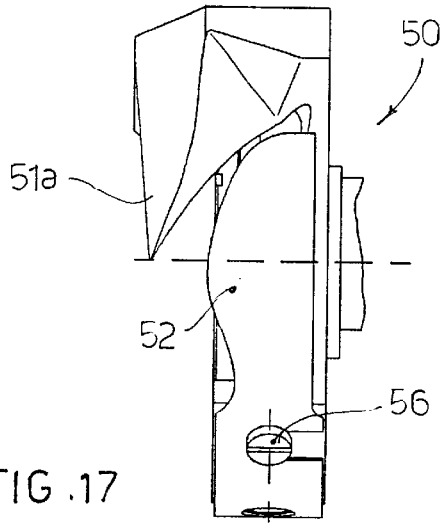
FIG .17
FIG . 16
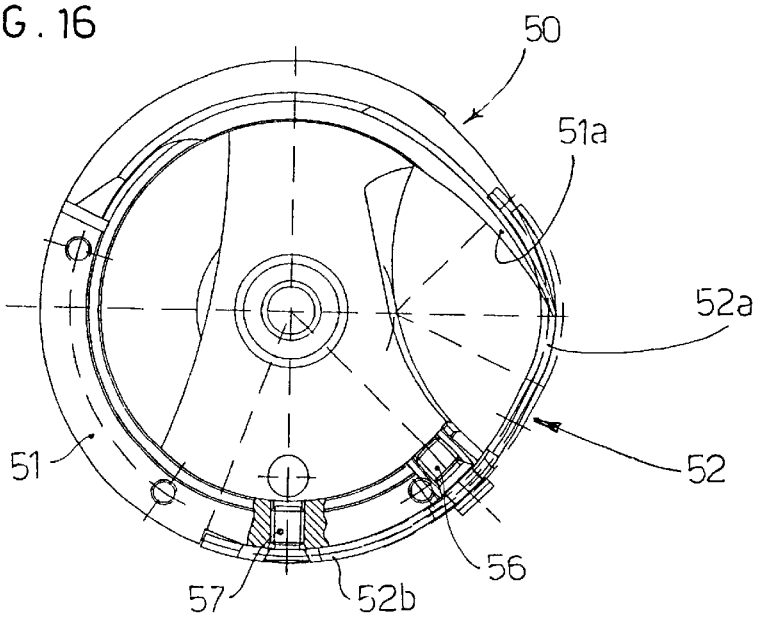

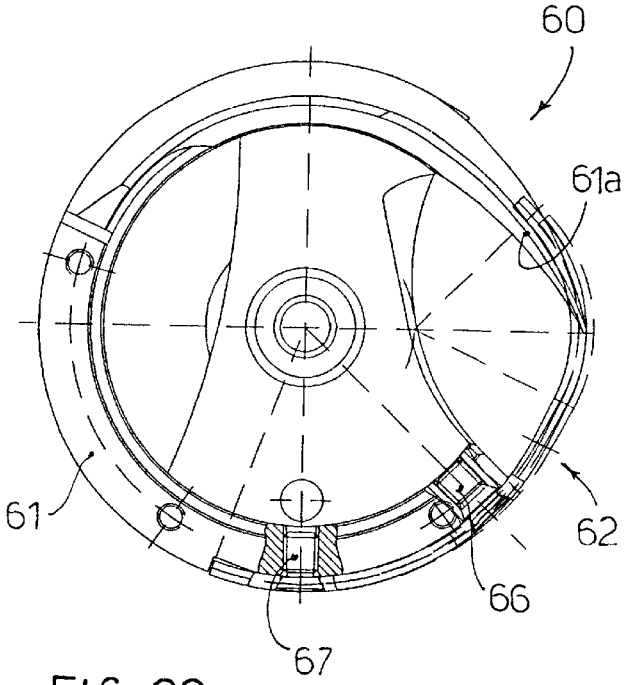
FIG. 22
FIG. 23
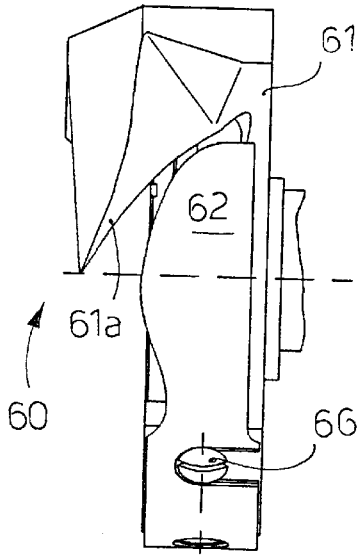
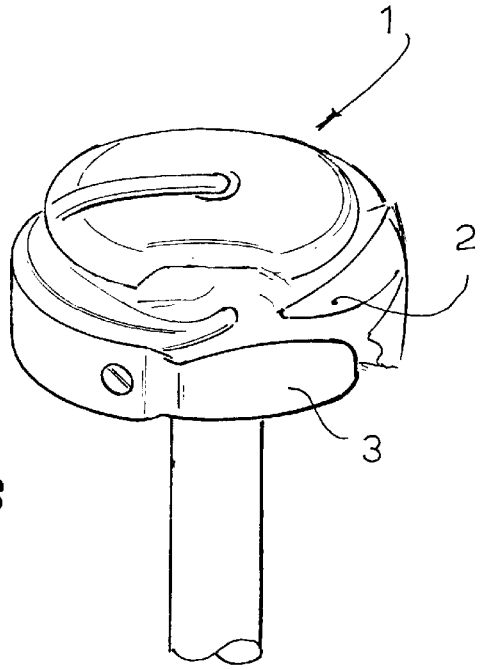
FIG. 28

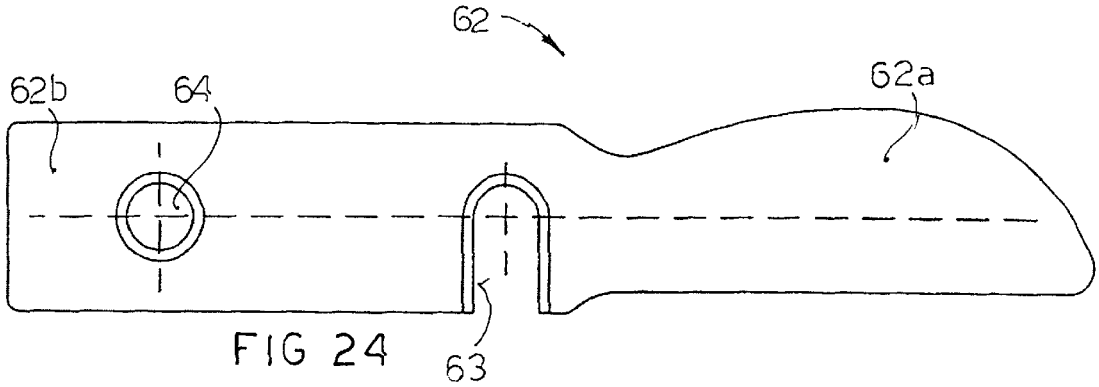
FIG 24
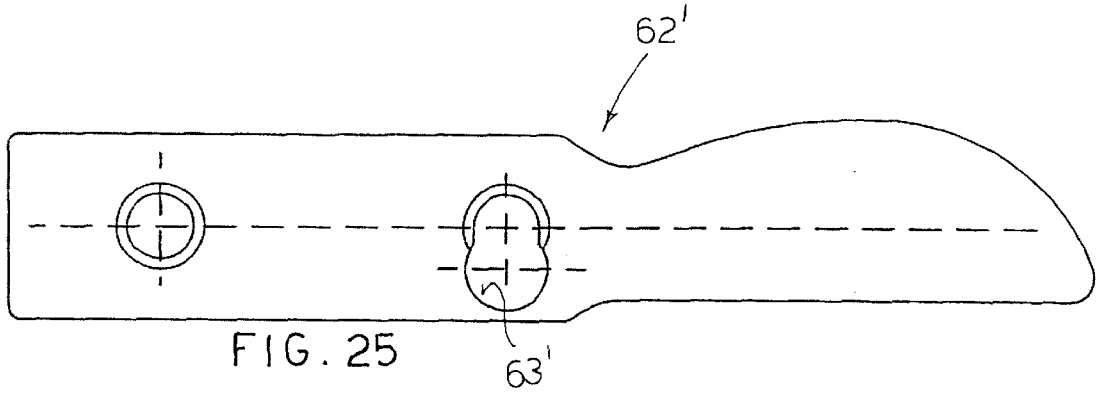
FIG. 25
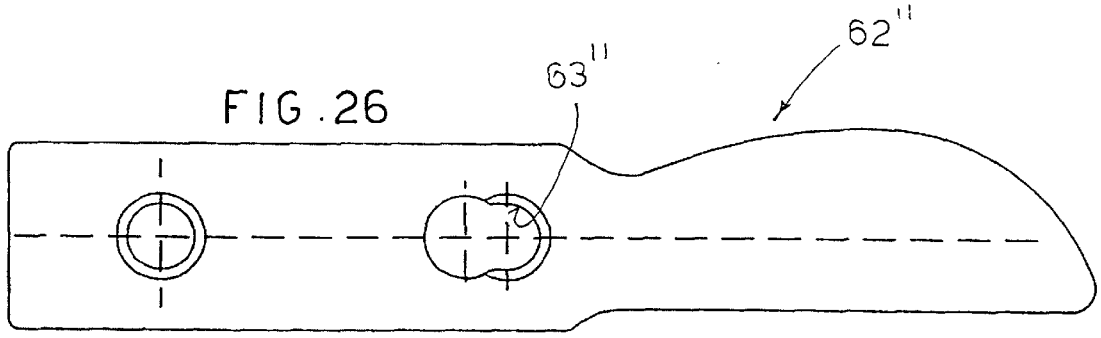
FIG. 26
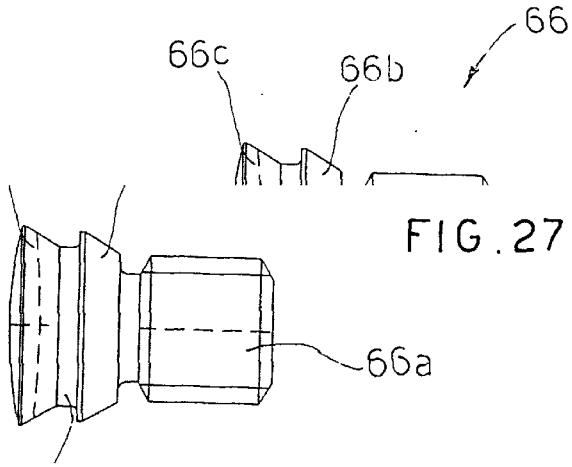
FIG. 27
FIG. 27

VERTICAL AXIS HOOK FOR LOCKSTITCH SEWING MACHINE, WITH SCREW-ADJUSTABLE NEEDLE GUARD PLATE

FIELD OF THE INVENTION

The present invention refers to adjustment of the needle guard plate on a vertical axis hook or crochet of a lockstitch sewing machine.

BACKGROUND OF THE INVENTION

In lockstitch sewing machines the crochet or hook has a peripheral "hook point" extending for a distance along the circumference of the hook. The hook, by rotating around its own axis, grips with said point the loop formed by the upper thread or needle thread, a loop which forms at the start of the movement of withdrawal or raising of the needle. The point of the hook must brush the needle to grip the loop of thread. Any bending of the needle, due for example to the force exerted thereon by a sideways translation of the fabric, could bring it to be situated on the trajectory of the hook point and could cause a collision with probable breakage of the needle or splintering of the hook point. In order to avoid this, a needle guard plate is provided which serves to prevent the needle from bending in the direction of the hook tip. The plate has an arched shape, in its working portion seen in a plan view, and rotates integrally with the hook body.

FIG. 28 is a top perspective view illustrating a vertical axis hook 1, according to the prior art, provided with a hook point 2, and a needle-protecting plate, or needle-guard plate, denoted by reference numeral 3.

Adjustment of the position of the plate in a radial direction with respect to the axis of the hook is generally required or desirable to adapt the hook to the type and size of needle used. The state of the art comprises various solutions for mounting plates on the hook body, so as to be able to perform said adjustment. Needle guard plates are generally considered to be grouped into three families according to the type of construction: a first family comprises so-called "flange plates", formed by a sheet of metal bent into an L-shape which is placed with the flat part between the hook and its axial resting point on the sewing machine; a second family comprises "flange-mounted plates" wherein a flange is fastened to the rear part of the hook; a third family comprises the "peripheral plates", obtained from sheet metal bent in an arch and fastened to the side of the hook body.

The subject matter of the present invention concerns the field of peripheral plates.

Peripheral plates are positioned on and fastened to the body of the hook. Some currently known and used methods of fastening will be described briefly.

According to a first method, the plate is mounted on the side of the hook by means of two head countersunk screws which centre the respective seats on the plate and therefore perform both the positioning function and that of fastening of the plate. The two screws are in proximity to the opposite end of the plate with respect to the hook point and leave the part of the plate near the hook point projecting. A variant of said system consists in fastening with four screws, two for each end of the plate.

In a second manner, the plate is positioned in a circumferential groove on the side of the hook and is fastened by means of two flat-headed screws, which therefore serve no positioning function, but only that of fastening.

As far as adjustment of peripheral plates is concerned, the following three systems are known and used.

a) The mounted plate is adjusted only by manual deformation of the bending curve of the projecting part with respect to the positioning and fastening system. Adjustment can therefore be only rough.

b) A third screw is placed on the side of the body of the hook at the opposite end of the needle guard plate with respect to the positioning and fastening portion. The screw, when it is loosened, presses on the tip of the plate and obliges outward deformation thereof. The screw normally requires a braking system (typically a locking thread) and holds the disadvantage of not being able to be applied to all hooks, in that it requires an adequate space, on the side of the hook and near the hook tip, a space which often is not available. Such an adjustment system is described in patents DE G 8116870 and IT 1151267.

c) In the case of the hook with a plate positioned in the groove, whilst positioning of the plate is performed by the groove and fastening of the plate by the flat-headed screw nearest the end of the plate, for fine adjustment use is made of the second screw, positioned between the fastening screw and the tip of the plate at the hook point. In this case the plate has a double bend which, without the second screw, would position it far to the outside of the hook tip. By screwing the second screw, on the other hand, the plate is forced inwards.

SUMMARY OF THE INVENTION

An object of the present invention is to reduce production costs of hook with an adjustable plate.

A further object is to be able to apply a finely adjustable plate on a hook where this was not hitherto possible because of problems of space.

The object has been achieved with a hook as stated in claim 1. Further new and useful characteristics are disclosed in the dependent claims.

In other words, in the hook of the invention fine adjustment of the peripheral needle guard plate is achieved without the need for a third screw in proximity to the point of the hook and with the sole function of adjustment, and without the need for a slot for positioning of the plate.

In one embodiment, three screws (two countersunk head for fastening and positioning and one for adjustment), all positioned on the portion of plate opposite that facing towards the hook point. The plate has a double bend and the third screw forces the plate inward.

In another embodiment, two countersunk head screws are used, one of which serves for positioning and fastening, whereas the second serves for positioning and adjustment. The plate has a double bend and the second screw forces the plate inwards.

In a third embodiment, two screws are used, one countersunk head for fastening and the second flat-headed for positioning and adjustment, having a cylindrical shape between the head and the thread which couples with a horizontal slot on the plate.

In a fourth embodiment two screws are used, the first being countersunk head and having a positioning and fastening function, whereas the second, serving for positioning and adjustment, works in thrust and is shaped with a cylindrical pin protruding from the head of the screw. Said pin enters a hole or slot in the plate and it is also possible from the pin to act to tighten or loosen said screw. The plate is naturally bent inwards and is forced outwards by loosening the screw.

In a fifth embodiment two screws are used, the first of which is countersunk head and serves for positioning and adjustment, whereas the second serves for positioning and adjustment. The second screw serves for "dual effect" adjustment: that is, it works both in traction and in thrust, depending on whether it is more or less tightened. The plate is bent to be level with the hook point with the adjustment screw half tightened. The adjustment screw has two flanges that remain one on the inside and one on the outside of the needle guard plate. The outer flange is flat in shape.

A sixth embodiment is similar to the fifth but the outer flange of the adjustment screw is conical.

The invention achieves the aforementioned objects, in particular it achieves lower production costs for the hook and allows simplified adjustment where it was not otherwise possible.

BRIEF DESCRIPTION OF THE DRAWINGS

Exemplary embodiments of the invention, will be described hereunder by way of non-limiting illustration with reference to the appended figures, wherein:

FIG. 10 is a view of the plate of the hook of FIGS. 8 and 9, on an enlarged scale and in the extended condition, FIG. 11 is an enlarged side view of an adjustment screw for the plate of the hook of FIGS. 8 and 9, FIG. 12 is a plan view of a hook according to a fourth embodiment, with the plate drawn with a solid line in one extreme position and with a dashed line in the other extreme position, FIG. 13 is a side view from the right of the hook of the preceding figure, FIG. 14 is an enlarged side view of the plate of the hook of FIGS. 12 and 13 in the extended condition, FIG. 15 is an enlarged side view of an adjustment screw for the hook of FIGS. 13 and 14, FIG. 16 is a partially sectional plan view of a hook according to a fifth embodiment, with the plate drawn with a solid line in one extreme position and with a dashed line in the other extreme position, FIG. 17 is a side view from the right of the hook of FIG. 16, FIG. 22 is a partially sectional plan view of a hook according to a sixth embodiment, with the plate drawn with a solid line in one extreme position and with a dashed line in the other extreme position, FIG. 23 is a side view from the right of the hook of FIG. 22, FIG. 24 is an enlarged side view of the plate of the hook of FIGS. 22 and 23, in the extended position, FIG. 25 is an enlarged side view of a variant of the plate of the hook of FIGS. 22 and 23, in an extended position, FIG. 26 is an enlarged side view of another variant of the plate of the hook of FIGS. 22 and 23, in an extended condition, FIG. 27 is an enlarged side view of an adjustment screw for the plate of the hook of FIGS. 22–26;

FIG. 28 is a perspective view of a hook according to the state of the art.

Figure 2:
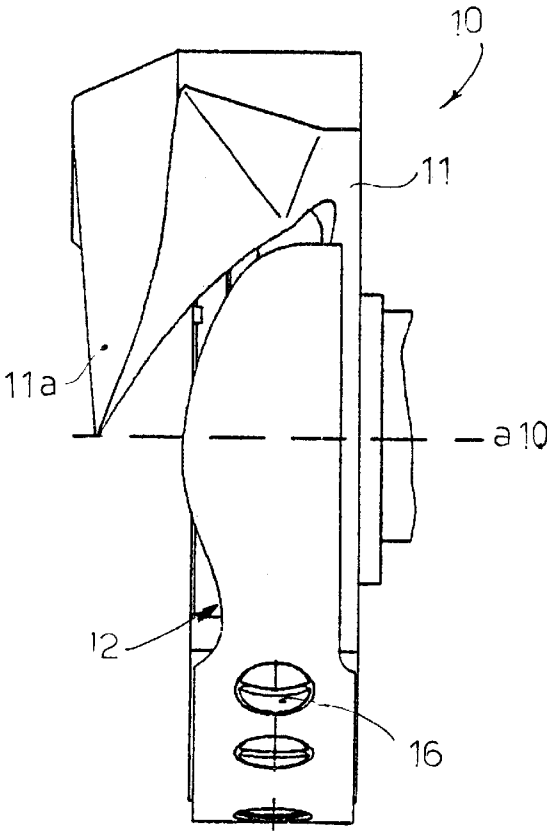
FIG. 2 is a side view from the right of FIG. 1.

A hook according to the prior art has been described above with reference to FIG. 28.

DETAILED DESCRIPTION OF THE PREFERRED EMBODIMENT

With reference first to FIGS. 1 to 4, a hook according to the invention is designated as a whole with reference numeral 10, is rotatable around its own axis denoted by a 10 and comprises a hook body 11, with a hook point, 11*a*, and a needle-guard plate of the hook, 12.

Figure 3:
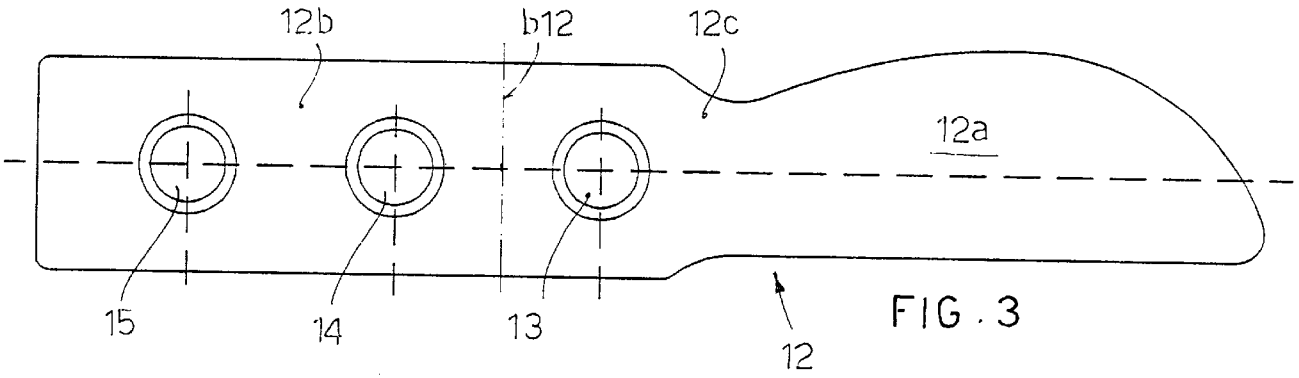
FIG. 3 is a view of the hook plate of FIGS. 1 and 2, on an enlarged scale and in the extended position.

The plate 12 can be seen better in FIG. 3, wherein it is illustrated enlarged and extended. The plate comprises a working portion 12*a* facing towards the tip of the hook and designed to cooperate therewith, and a fastening and positioning portion 12*b*. The working portion, in the view of FIG. 3, has a tapered and rounded shape at the distal end, having a narrow neck 12*c* and an adjustment hole or slot 13 at the proximal end. The fastening portion of the plate is substantially rectangular in shape and has two aligned fastening and positioning holes, denoted by 14, 15. All three holes 13, 14, 15 have an outwardly countersunk aperture. The plate 12 is applied to the hook. The fastening portion 12*b* thereof is curved in an arc of a circle, in a manner corresponding to the curvature of the hook body. The working portion 12*a* has a double curvature, that is to say, it is curved outwardly (with respect to the axis of the hook crochet) in the area corresponding to the line b12 drawn dashed, between the holes 13 and 14, and it is curved in an arch around the axis of the hook in its distal portion.

Figure 1:
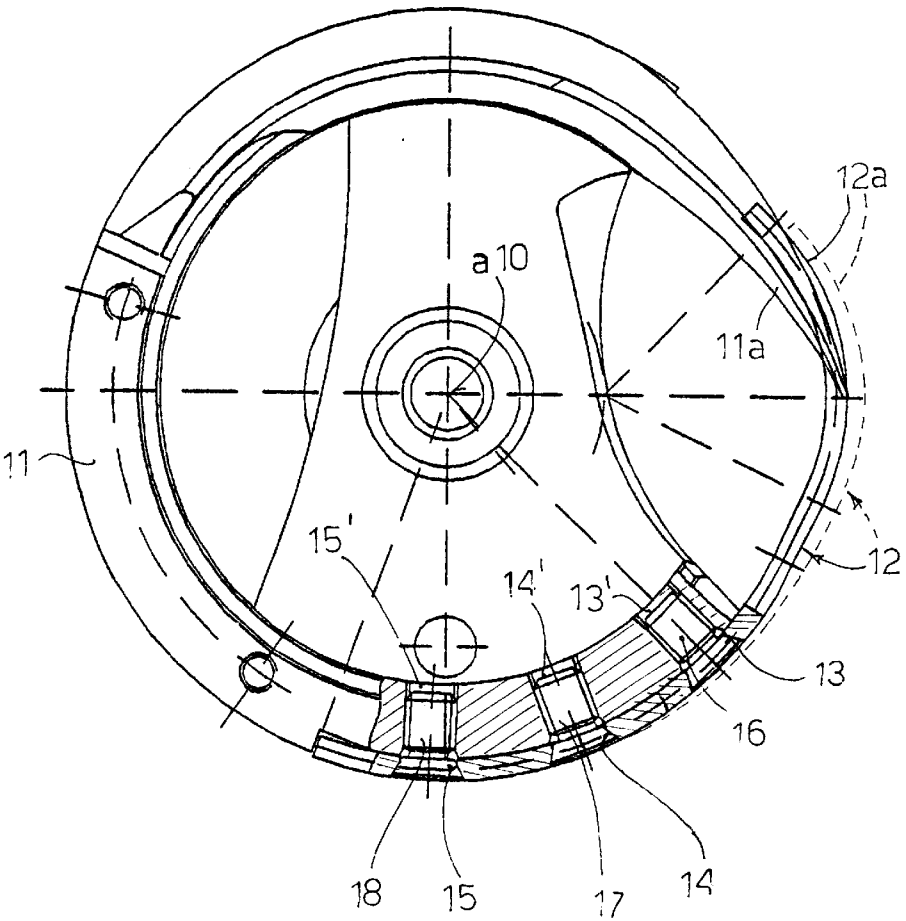
FIG. 1 is a partially sectional plan view of a vertical axis hook according to a first embodiment of the invention; the plate is drawn with a slid line in an extreme position of adjustment near the axis a10 of the hook, with a dashed line in the other extreme position of adjustment farther from the axis a10.
Figure 4:
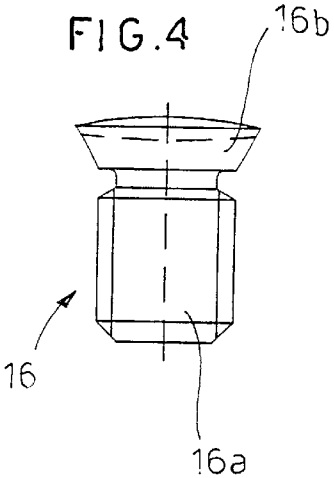
FIG. 4 is a side view on an enlarged scale of a fastening and adjustment screw for the plate of the first embodiment.

The plate 12 is applied to the hook by means of three screws indicated by 16, 17 and 18 (FIG. 1). The screw 16 is an adjustment screw and occupies the hole 13 of the plate, the screws 17 and 18 are fastening and positioning screws, and occupy the holes 14 and 15 of the plate. The three screws screw into the threaded holes 13', 14' and 15' in the hook body. In this embodiment, the three screws 16, 17 and 18 are identical. In FIG. 4 the screw 16, which is of a per se known type, comprising a threaded shank 16*a* and a countersunk head 16*b*, is illustrated. The head of the screw 16 could also be cylindrical and consequently not require countersinking of the hole 13.

The plate 12 is mounted on the body of the hook around the periphery thereof, and fastened and positioned level with its fastening portion with the screws 17 and 18, in a per se known manner. Owing to the deformation that has been imparted to it, the plate is disposed with its working portion slightly distanced from the periphery of the hook body (position indicated by dashed line). The screw 16 engages the working portion of the blade and the body. By tightening the screw 16 the blade is forced toward the hook crochet body (axis), by loosening the screw the very elasticity of the plate moves it away from the hook body; it is thus possible to adjust the position of the plate with respect to the point 11 (to the axis a 10) of the hook.

Figure 6:
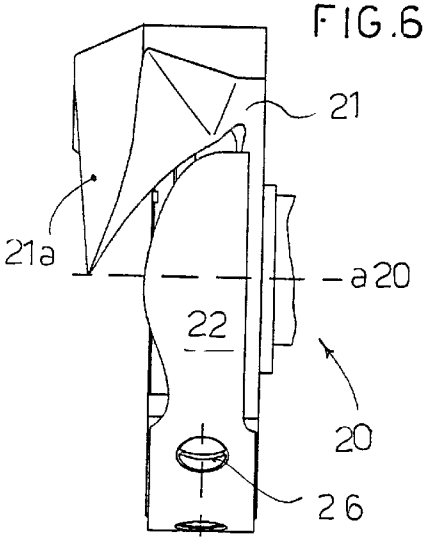
FIG. 6 is a view from the right with respect to FIG. 5.
Figure 5:
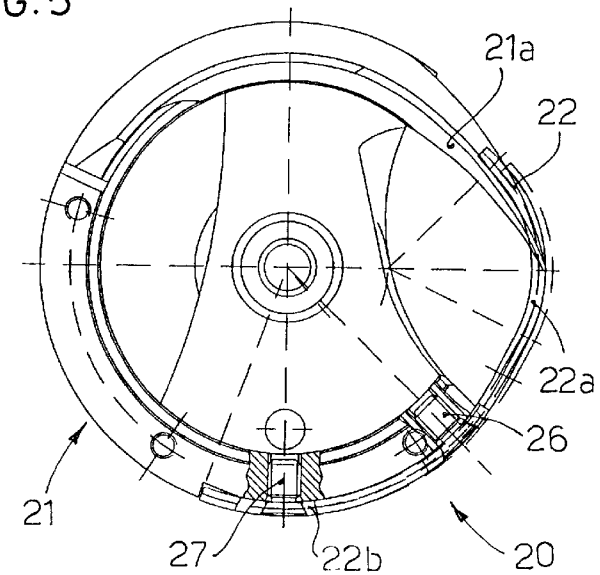
FIG. 5 is a partially sectional plan view of a hook according to a second embodiment of the invention, with the adjustable plate in the extreme position nearest the axis a20 and the adjustment screw completely tightened; the plate in the adjusted position furthest from the axis a20 of the hook is shown with a dashed line.
Figure 7:
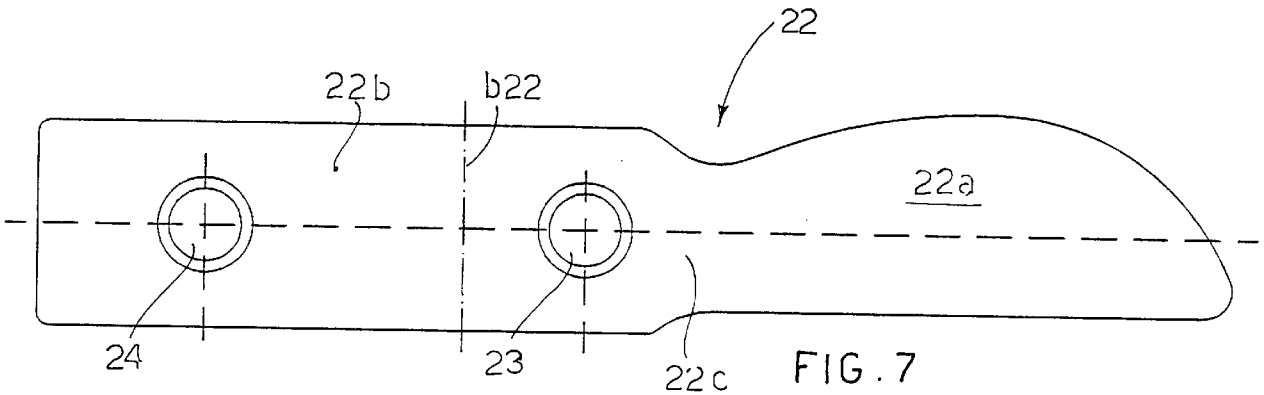
FIG. 7 is a view of the plate of the hook of FIGS. 5 and 6, on an enlarged scale and in the extended condition.
Figure 9:
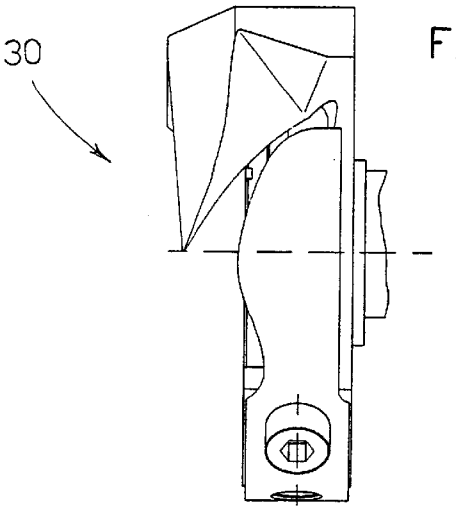
FIG. 9 is a side view from the right of FIG. 8.
Figure 8:
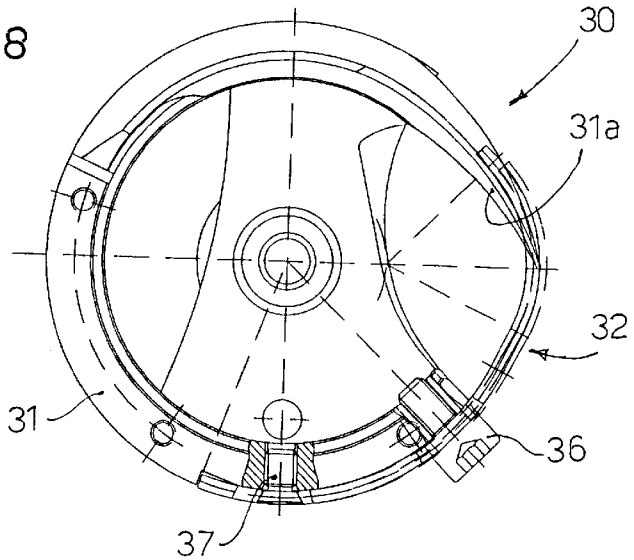
FIG. 8 is a partially sectional plan view of a third embodiment of the hook according to the invention, with plate indicated with a solid line in one extreme position and with a dashed line in the other extreme position.

A second embodiment of the hook (rotatable around the axis a20) with adjustable plate is indicated by reference numeral 20 and illustrated in appended FIGS. 5, 6 and 7; it comprises a hook body 21 with a hook point 21*a*, and a hook plate 22.

The plate 22 can be seen better in FIG. 7, wherein it is illustrated enlarged, and extended. The plate comprises a working portion 22*a* facing towards the hook point and designed to cooperate therewith and a fastening and positioning portion 22*b*. The working portion, in the view of FIG. 7, is tapered and rounded in shape at the distal end, has a narrow neck 22*c* and an adjustment hole 23 at the proximal end. The fastening portion 22*b* of the plate is substantially rectangular in shape and has a fastening and positioning hole, indicated by 24. The holes 23, 24 have an outwardly countersunk opening. The plate 22 is applied to the hook. The fastening portion 22*b* thereof is curved in an arc of a circle, in a manner corresponding to the curvature of the hook body. The working portion 22*a* has a double curvature, that is to say it is curved outward (with respect to the hook axis) in the area corresponding to the dashed line b22, between the holes 23 and 24, and it is curved in an arch around the axis of the hook in its distal portion.

The plate 22 is applied to the hook by means of two screws indicated by 26 and 27. The screw 26 is a positioning and adjustment screw, the screw 27 is a fastening and positioning screw. In this embodiment, the two screws 26, 27 are identical and identical to the screw 16 illustrated in FIG. 4.

The plate 22 is mounted on the hook body around the periphery thereof, and fastened and positioned at its fastening portion with the screw 27, in a per se known manner. Owing to the deformation that has been imparted to it, the plate is disposed with its working portion slightly distanced from the periphery of the hook body. The screw 26 engages the working portion of the plate and the body. By tightening and loosening the screw 26 it is possible to adjust the position of the plate 22 with respect to the point 21*a* of the hook 21. The screw 26 serves for adjustment and positioning of the plate, that is to say it adjusts the position of the plate towards or away from the hook point (from the axis of the hook) and positions the plate in the direction of the axis a 20.

A third embodiment of the hook with an adjustable plate is indicated by reference numeral 30 and illustrated in appended FIGS. 8, 9, 10 and 11; it comprises a hook body 31 with a hook point 31*a* and a hook plate 32.

The plate 32 can be seen better in FIG. 10, wherein it is illustrated enlarged and extended. The plate comprises a working portion 32*a* facing towards the hook point, and designed to cooperate therewith, and a fastening and positioning portion 32*b*. The working portion, in the view of FIG. 10, is tapered and rounded in shape at the distal end, has a narrow neck 32*c* and an adjustment slot 33 at the proximal end. The shape of the slot 33 is elongated longitudinally with respect to the plate. The fastening portion of the plate is substantially rectangular in shape and has a fastening and positioning hole, indicated by 34, with an outwardly countersunk opening. The plate 32 is applied to the hook. The fastening portion 32*b* thereof is curved in an arc of a circle, in a manner corresponding to the curvature of the hook body. The working portion 32*a* has a double curvature, that is to say it is curved outward (with respect to the hook axis) in the area corresponding to the line b32 drawn with a dashed line, between the holes 33 and 34, and is curved in an arch around the axis of the hook in the distal portion thereof. The plate 32 is applied to the hook by means of two screws denoted by 36 and 37. The screw 36 is an adjusting and positioning screw, the screw 37 is a fastening and positioning screw. The screw 37 is identical to the screw 16 illustrated in FIG. 4. The screw 36 is illustrated in FIG. 11 and has a threaded shank 36*a*, a cylindrical neck 36*b*, and a widened cylindrical head 36*c*. The diameter of the neck is smaller that the transverse measurement of the slot 33, the diameter of the head is greater that the transverse measurement of the slot. The plate 32 is mounted on the hook body around the periphery thereof, and fixed and positioned at its fastening portion with the screw 37, in a per se known manner. Owing to the deformation that has been imparted thereto, the plate is disposed with its working portion slightly distanced from the periphery of the hook body. The screw 36 engages the working portion of the plate with its portion 36*b* and the shoulder 36'*c* of the head 36*c* and the hook body with its threaded part 36*a*.

By tightening and loosening the screw 36 it is possible to adjust the position of the plate with respect to the hook point 31.

A fourth embodiment of the hook with an adjustable plate is indicated by reference numeral 40 and illustrated in appended FIGS. 12, 13, 14 and 15; it comprises a hook body 41 with a hook point 41*a*, and a hook plate 42.

The plate 42 can be seen better in FIG. 14, wherein it is illustrated enlarged and extended. In this view, it is identical to the plate 32 of the previous embodiment. It therefore comprises a working portion 42*a* facing towards the hook point and designed to cooperate therewith, and a fastening and positioning portion 42*b*. The working portion, in the view in FIG. 14, is tapered and rounded in shape at the distal end, has a narrow neck 42*c* and an adjustment slot 43 at the proximal end. The shape of the slot 43 is elongated longitudinally with respect to the plate. The fastening portion of the plate is substantially rectangular in shape and has a fastening and positioning hole, denoted by 44, with an outwardly countersunk opening. The plate 42 is applied to the hook and is curved in an arc of a circle, in a manner corresponding to the curvature of the hook body. The working portion 42*a* is preliminarily curved inward, towards the axis of the hook, with respect to the hook point 41*a*.

The plate 42 is applied to the hook crochet by means of two screws denoted by 46, 47. The screw 46 is a plate adjusting and positioning screw, the screw 47 is a fastening and positioning screw identical to the screw 16 illustrated in FIG. 4. The screw 46 (FIG. 15) has a threaded shank 46*a*, a countersunk flange 46*b*, and a cylindrical head 46*c*. The maximum diameter of the countersunk flange is greater than the transverse measurement of the slot 43; the diameter of the head 46*c* is smaller than the transverse measurement of the slot.

The plate 42 is mounted on the hook body around the periphery thereof, and fastened and positioned at its fastening portion with the screw 47, in a per se known manner, after having engaged the adjustment screw 46 in a suitable countersunk hole in the hook body. The screw 46 engages the slot 43 of the plate with its cylindrical head and the surface of the plate facing toward the hook body with the abutment surface 46'*b* of the countersunk flange. By loosening the screw 46 it is possible to adjust the position of the plate bringing it away from the hook axis, by tightening the screw 46, the plate is returned towards the hook axis by its own elasticity.

A fifth embodiment of the hook with an adjustable plate is indicated by reference numeral 50 and illustrated in appended FIGS. 16–21; it comprises a hook body 51 with a hook point 51*a* and a hook crochet plate 52. The plate 52 can be seen better in FIG. 18, wherein it is illustrated enlarged and extended. It comprises a working portion 52*a* facing towards the hook point, and designed to cooperate therewith, and a fastening and positioning portion 52*b*.

Figure 18:
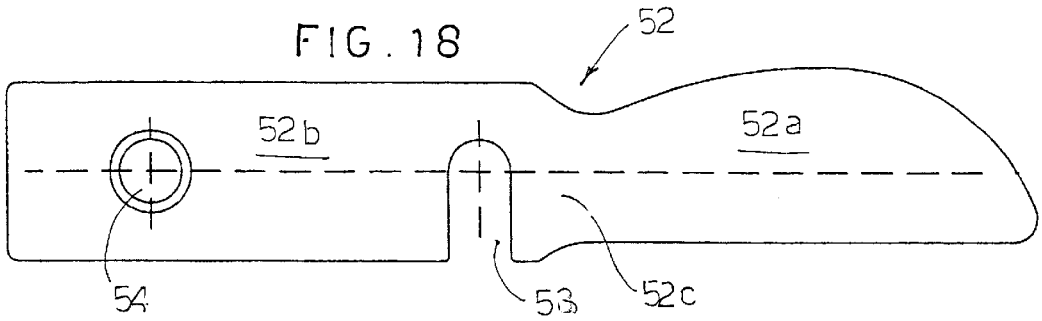
FIG. 18 is an enlarged side view of the plate of the hook of FIGS. 16 and 17, in the extended condition.

The working portion, in the view of FIG. 18, is tapered and rounded in shape at the distal end, has a narrow neck 52*c* and an adjustment slot 53 open on one side. The fastening portion of the plate is substantially rectangular in shape and has a fastening and positioning hole, designated by 54, with an outwardly countersunk opening. The plate 52 is applied to the hook crochet with the fastening portion 52*b* thereof, curved in an arc of a circle, in a manner corresponding to the curvature of the hook body. The working portion 52*a* is also curved according to the periphery of the hook body.

The plate 52 is applied to the hook by means of two screws denoted by 56, 57. The screw 56 is a plate adjusting and positioning screw; the screw 57 is a fastening and positioning screw identical to the screw 16 illustrated in FIG. 4. The screw 56 has a threaded shank 56*a*, a countersunk flange 56*b*, a cylindrical flange 56*c*, and a neck 56*d* therebetween. The maximum diameter of the flanges is greater than the width of the slot 53; the diameter of the neck 56*d* is smaller than the transverse measurement of the slot.

The plate 52 is mounted on the hook body around the periphery thereof after the screw 56 has been inserted with the neck 56*d* in the slot 53, and is fastened and positioned at its fastening portion with the screw 57, in a per se known manner. The screw 56 engages the slot of the plate with the neck 56d, and engages the surface of the plate facing towards the body of the hook with the abutment surface of its countersunk flange 56*b*, or the outer surface of the plate with the abutment surface of the cylindrical outer flange 56*c*, depending on whether the screw is acted upon to bring plate away from or toward the hook axis.

Figure 19:
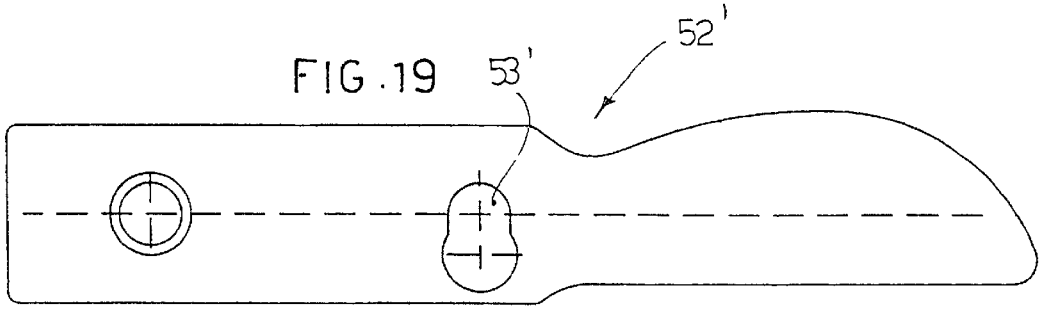
FIG. 19 is an enlarged side view of the plate of the hook of FIGS. 16 and 17, in the extended condition.
Figure 20:
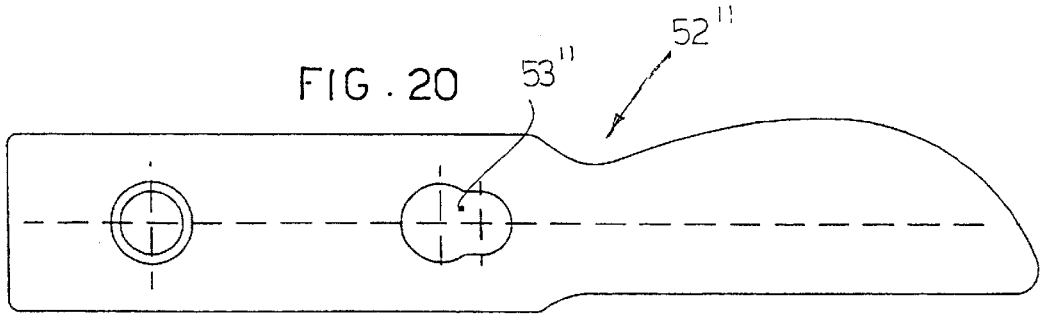
FIG. 20 is an enlarged side view of another variant of the plate of the hook of FIGS. 16 and 17, in the extended condition.
Figure 21:
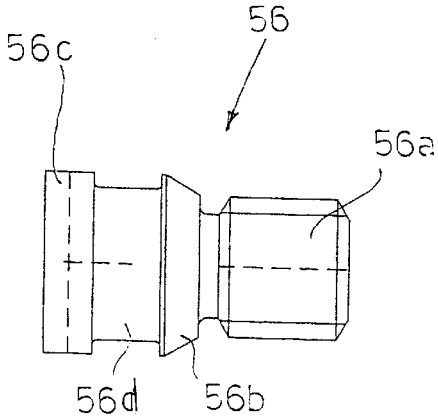
FIG. 21 is an enlarged side view of an adjustment screw for the plate of the hook in FIG. 18.

FIGS. 19 and 20 present variants of the plate that it is possible to use with the hook 50 and the screw 56. The plate 52' has, instead of the slot 53, a slot 53' made up of two portions with different diameters, with their axes aligned transversally to the longitudinal dimension of the plate. The portion with the largest diameter allows the passage of the flanges of the adjustment screw; the portion with the smallest diameter has a smaller diameter than the flanges and a larger diameter than the neck 56*d* of the adjustment screw. The plate 52" is similar to 52' except that the slot with two diameters 53" has the axis of the two portions aligned longitudinally with respect to the plate.

A sixth embodiment of the hook with an adjustable plate is indicated by reference numeral 60 and illustrated in appended FIGS. 22–27; it comprises a hook body 61 with a hook point 61 a and a hook plate 62.

The plate 62 and its variants 62', 62" can be seen better in FIGS. 24, 25 and 26, wherein they are illustrated enlarged and extended. The plates correspond substantially to the plates 52, 52' and 52", except that the adjustment slot 63, 63', 63", or the part of the adjustment slot with the smallest diameter, has countersunk walls. No detailed description of the plates 62, 62', 62" will therefore be given.

The plate 62 is applied to the hook by means of two screws designated 66, 67. The screw 66 is an adjusting and positioning screw; the screw 67 is a fastening and positioning screw identical to the screw 16 illustrated in FIG. 4. The screw 66 has a threaded shank 66*a*, a proximal countersunk flange 66*b*, a distal countersunk flange 66*c*, and a neck 66*d* therebetween. The maximum diameter of the flanges is greater than the width of the slot or of the part of the plate slots with the smallest diameter; the diameter of the neck 66*d* is smaller than the transverse measurement of the slot or of the part of the slot with the smallest diameter.

The screw 66 engages the slot of the plate with the neck 66*d*, and engages the surface of the plate towards the hook body with its proximal flange 66*b*, or the outer surface of the plate with respect to the hook with its distal flange 66*c*, depending on whether the screw is acted upon to move the plate away from or toward the hook axis.

Further variants are possible and it is understood that all variants accessible to a person skilled in the art of normal experience in any case come within the scope of the invention as set forth in the appended claims.

What is claimed is:

1. A vertical axis hook for a lockstitch sewing machine, comprising a hook body with a hook point, a peripheral needle guard plate mounted on the side of the hook body, the plate comprising a fastening and positioning portion and an adjustable portion integral with each other, further comprising a screw adjustment means for the plate to adjust the position of the adjustable portion with respect to the hook axis, characterised in that the positioning, fastening and adjusting functions are performed by means of screws.

2. A hook according to claim 1, characterised in that the plate adjustment screw is also a positioning means and acts in a position of the adjustable portion of the plate that is near the fastening portion thereof.

3. A hook according to claim 2, characterised in that the plate has the fastening and positioning portion mounted on the hook body by means of two screw means, the adjustable portion of the plate is predeformed outwards with respect to the axis of the hook, the adjustment means is a screw which cooperates with a hole situated in the adjustment portion of the plate in proximity to the fastening portion.

4. A hook according to claim 2, characterised in that the fastening and positioning portion of the plate is mounted on the hook body by means of a screw means, the adjustable portion of the plate is predeformed outwards with respect to the hook axis, the adjustment means is a screw with a countersunk head that cooperates with a countersunk hole situated in the adjustment portion of the plate in proximity to the fastening portion.

5. A hook according to claim 2 characterised in that the fastening and positioning portion of the plate is mounted on the hook body by means of a screw means, the adjustable portion is predeformed outwards with respect to the hook axis, the adjustment means is a screw with a cylindrical neck that cooperates with an adjustment slot elongated longitudinally with respect to the plate and situated in the adjustment portion of the plate in proximity to the fastening portion.

6. A hook according to claim 2, characterised in that the fastening and positioning portion of the plate is mounted on the hook body by means of a screw means, the adjustable portion is predeformed inwards with respect to the hook axis, the adjustment means is a screw which comprises a flange and a cylindrical head part that cooperates with an adjustment slot elongated longitudinally with respect to the plate and situated in the adjustment portion of the plate in proximity to the fastening portion.

7. A hook according to claim 2, characterised in that the fastening and positioning portion of the plate is mounted on the hook body by means of a screw means, the adjustment means is a screw whereof the head comprises a flange, a neck and a cylindrical part, and the screw cooperates with an opening of the plate situated in the adjustment portion of the plate in proximity to the fastening portion.

8. A hook according to claim 7 wherein the opening has at least one diameter no smaller than the diameter of the neck of the screw and a shape among the following: slot open on one side of the plate, elongated hole with a largest diameter part sufficient to allow the passage of the largest diameter part of the screw head.

9. A hook according to claim 2, characterised in that the fastening and positioning portion of the plate is mounted on the hook body by means of a screw means, the adjustment means is a screw whereof the head comprises a flange, a neck and a second inwardly countersunk flange, and the screw cooperates with an at least partially countersunk opening of the plate situated in the adjustment portion of the plate in proximity to the fastening portion.

10. A hook according to claim 9 wherein the opening has one of the following shapes: slot open on one side and with countersunk edges, a slot with a minimum diameter portion with countersunk edges, with a diameter no smaller than the diameter of the neck of the screw and no larger than the diameter of the countersunk flanges of the screw and with a largest diameter portion no smaller than the diameter of the countersunk flanges.

11. A hook according to claim 1, characterised in that the plate has the fastening and positioning portion mounted on the hook body by means of two screw means, the adjustable portion of the plate is predeformed outwards with respect to the hook axis, the adjustment means is a screw that cooperates with a hole situated in the adjustment portion of the plate in proximity to the fastening portion.

12. A hook according to claim 2, characterised in that the fastening and positioning portion of the plate is mounted on the hook body by means of a screw means, the adjustable portion is predeformed inwards with respect to the hook axis, the adjustment means is a screw which comprises a flange and a cylindrical head part that cooperates with a hole situated in the adjustment portion of the plate in proximity to the fastening portion.

13. A hook plate for a lockstitch sewing machine, comprising a fastening and positioning portion and an adjustment portion in one piece, at least one countersunk fastening and positioning hole in said fastening and positioning portion, characterised in that it comprises at least one opening for radial position adjustment and axial positioning in said adjustment portion, situated in the part of the adjustment portion towards the fastening portion.

14. A plate according to claim 13 wherein the adjustment opening has one of the following shapes: countersunk circular hole, elongated slot, slot open on one side, slot with two diameters elongated transversely or longitudinally with respect to the plate and with the edge at least partially countersunk.

15. A plate according to claim 13 with the adjustment portion predeformed so as to be radially toward the inside or toward the outside with respect to the fastening portion.

16. An adjusting and positioning screw for a needle guard plate of a hook for a lockstitch sewing machine, comprising a threaded shank and an adjustment portion characterised in that the adjustment portion is configured for a positioning and adjusting function.

17. A screw according to claim 16 characterised in that the adjustment and positioning portion has one of the following configurations:

with a cylindrical neck and head;

widened cylinder with shoulder towards the neck;

with flange and cylindrical head with a smaller diameter than the widest diameter of the flange;

with two flanges at the head, spaced apart by a neck therebetween;

with a countersunk flange and a cylindrical flange, spaced apart, and a neck therebetween;

with countersunk flanges spaced apart by a neck.

* * * * *

UNITED STATES PATENT AND TRADEMARK OFFICE

CERTIFICATE OF CORRECTION

PATENT NO. : 6,748,887 B2
DATED : June 15, 2004
INVENTOR(S) : D. Cerliani

It is certified that error appears in the above-identified patent and that said Letters Patent is hereby corrected as shown below:

Title page,
Item [30], Foreign Application Priority Data, "MI2002A0456" should read
-- MI2002A000456 --

Signed and Sealed this

Twenty-second Day of March, 2005

JON W. DUDAS
*Director of the United States Patent and Trademark Office*